United States Patent [19]

Moss

[11] Patent Number: 4,491,193

[45] Date of Patent: Jan. 1, 1985

[54] KNEELING PLATFORM

[76] Inventor: Garry K. Moss, 21 W. 59th St., Apt. 28, Westmont, Ill. 60559

[21] Appl. No.: 427,642

[22] Filed: Sep. 29, 1982

[51] Int. Cl.[3] ..... A47C 16/04

[52] U.S. Cl. ..... 182/230; 224/158

[58] Field of Search ..... 182/230; 280/32.5, 32.6; 2/24; 224/158

[56] References Cited

U.S. PATENT DOCUMENTS

| | | | |
|---|---|---|---|
| 1,296,619 | 3/1919 | Bulat . | |
| 2,052,973 | 9/1936 | Furtzaig | 182/230 |
| 2,225,696 | 12/1940 | Holzderber | 182/230 |
| 2,487,706 | 11/1949 | Happ | 280/32.6 |
| 4,061,202 | 12/1977 | Campbell | 182/20 |

*Primary Examiner*—Reinaldo P. Machado

*Attorney, Agent, or Firm*—Kimbley L. Muller; Louis A. Morris

[57] ABSTRACT

A kneeling platform particularly suitable for carrying to worksites having uncomfortable or hazardous supporting surfaces and which may be reached only by climbing. The platform comprises a frame with a padded upper surface, a curved appendage at one edge capable of being hooked over the shoulder to enable carrying of the platform while leaving both arms free and feet mounted on the lower surface of the frame capable of the stable support of the platform on the supporting surface in question. The platform may be fitted with various storage and attachment means for tools and materials.

6 Claims, 2 Drawing Figures

KNEELING PLATFORM

BACKGROUND OF THE INVENTION

The idea of placing a protective means under the knees or other part of the body of a workman which would otherwise be in contact with a hard or otherwise hostile surface on which he may have to be supported while working is probably ancient. Examples of such means are the devices disclosed in U.S. Pat. Nos. 1,529,498 to Novak; 2,052,973 to Furtzaig; 2,225,696 to Holzderber; 3,499,502 to Rosander; 4,185,846 to Black; British Pat. No. 628,746 and Norwegian Pat. No. 79755. The devices of the above enumerated patents all include a platform or frame covered by a pad intended to provide a degree of comfort for the workman who kneels or lies down on the device while working. It is also common for these devices to have carrying and storage facilities such as hand holds and storage compartments like those shown as items 21 and 27, respectively, in the figures of the Holzderber patent.

The above prior art devices have serious shortcomings, particularly when the workman desires at one time to carry with him and use the device to protect him from an uncomfortable, slippery or otherwise hazardous supporting surface, carry with him and have convenient access to tools and working materials, and have both arms free and unencumbered to enable, when necessary, his climbing to the workplace.

it is also known that various objects may be attached to the human body by hooks which engage the shoulder from behind and enable the object to hang behind the person from his shoulders by the hooks. An example is the carrier for supporting sick or wounded individuals upon the back of the carrying person as shown in U.S. Pat. No. 1,296,619 to Bulat. There is nothing in Bulat, however, that suggests that such hooks might be incorporated with a kneeling platform nor, or course, suggests how such hooks might be so incorporated.

I have discovered a kneeling platform comprising a unique combination of features which enables the comfortable and secure support of a workman on almost any working surface, the carrying of the platform over the shoulder to allow both arms free for climbing and storage facilities appropriate for the type of work in question.

SUMMARY OF THE INVENTION

The present invention comprises, in its broadest embodiment, a kneeling platform comprising in combination: (a) a frame having upper and lower surfaces; (b) a kneeling pad mounted on the upper surface; (c) an arcuate shaped appendage affixed to an edge of the frame curving above and over the upper surface, the appendage being of a size and shape conforming to the human shoulder, thereby enabling the platform to be carried against the back by hooking the appendage over the shoulder; and (d) feet mounted on the lower surface capable of the stable support of the platform on a supporting surface, the portion of the feet in contact with the supporting surface, being of a composition having a high degree of adhesion with the supporting surface.

Other embodiments of the present invention include details of construction of the device, all of which are set forth in the following detailed discussion.

DETAILED DISCUSSION

My discovery of the above invention occurred in the course of my work as a mechanic in the repair and maintenance of semi-trailers. This type of work includes safety inspection, patching and sealing of holes, straightening of wind flap brackets, bumper straightening and innumerable other tasks which must from time to time be performed. The semi-trailer will be removed to a hangar or other protected environment for only the most major jobs.

About 85% of the work on the semi-trailers must be done out-of-doors, thus requiring the mechanic to perform work difficult and demanding under the best of conditions. Sometimes this work must be carried out during severe weather including instances when ice accumulates on surfaces to which the mechanic must climb which renders them extremely hazardous. The top surface of the semi-trailers may become so hot during warm weather and bright sunshine that contact with them by the unprotected body would be painful and injurious. The mechanic might also be required to kneel on rocks or asphalt on the ground around the trailer to perform such tasks as repairing a gear box (mechanism that extends the two legs that support the trailer when it is off the tractor).

There has been a long-felt need for a device that is particularly suitable for the type of work described above, but, until my invention, this need has been unfulfilled. The prior art devices fail to provide the unique combination of features of my invention, described in greater detail hereinbelow, which provide a degree of comfort, convenience and utility not heretofore realized.

Figure 1:
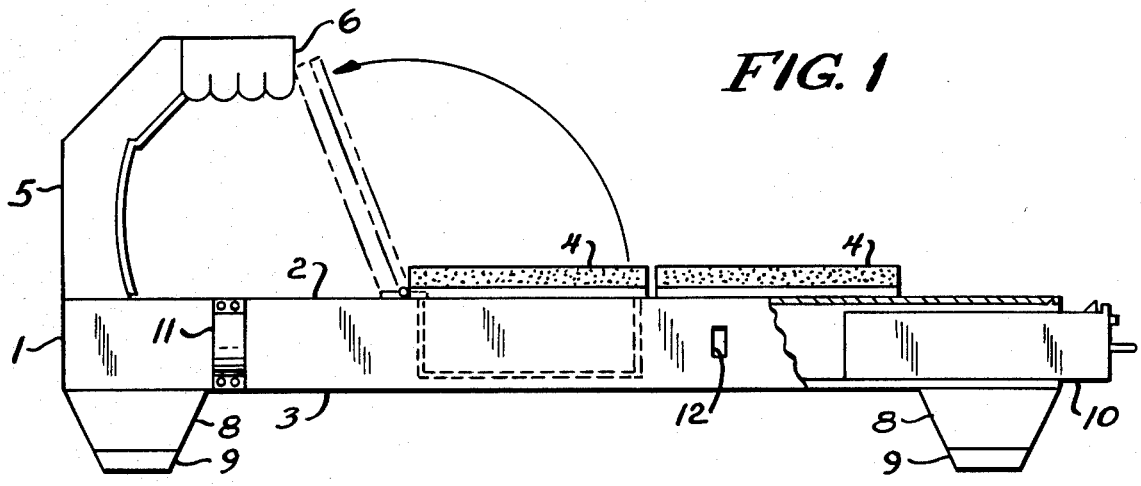
FIG. 1 provides a side parallel sectional view of the kneeling platform of the present invention including appendage 5 attached to the frame 1.

With reference to FIG. 1 in particular, unless stated otherwise, a particularly preferred embodiment of the present invention is illustrated where the frame 1 having upper and lower surfaces 2 and 3, respectively, defines a rectangular prism. The preferred length of frame 1 is from about 2 to 3 feet and the width from about 1 to $1\frac{1}{2}$ feet. The frame as well as the entire device, wherever appropriate, should be constructed of light but sufficiently strong material such as aluminum or light alloy. If the device is constructed from a metal casting, upper surface 2 would preferably be a continuous flat surface while lower surface 3 would be hollowed out so as to achieve minimum weight of the device without compromising its required strength. The underside of the casting would have means integral therewith and associated with surface 3 to enable the fitting of certain elements of the device discussed hereinbelow. Two kneeling pads 4 on upper surface 2 are shown, although only one is necessary as long as it has sufficient area to enable a workman to kneel on it with sufficient room for limited movement. A suitable pad would be 3-inch thick foam rubber mounted on a plywood or light alloy base. At least one of pads 4 is hinged to surface 2 so that the pad may be rotated on the hinge away from surface 2, as indicated by the dotted line, to expose a recess or bin in frame 1, otherwise covered by the pad, which may function as a storage compartment for tools and materials. The rotating pad should have a latching means on its edge opposite the hinged edge to prevent the pad from coming away from surface 2 when not desired, such as when the device is being carried.

Figure 2:
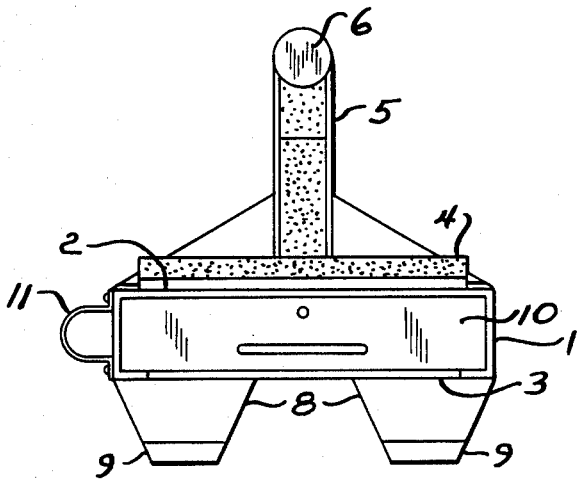
FIG. 2 is an end view of the device of FIG. 1 at the end opposite the end on which appendage 5 is attached.

Arcuate shaped appendage 5 is attached to an edge of frame 1 and curves above and over upper surface 2. Appendage 5 is of a size and shape conforming to the human shoulder to enable the device to be carried against the worker's back by hooking the appendage over his shoulder. Appendage 5 would preferably comprise a single hook, as shown in FIG. 2, symmetrical to the longitudinal axis of frame 1 which is of a width at the portion which curves around the right or left shoulder to enable comfortable support by the shoulder without interference with arm movements. The base of the appendage at surface 2 may be as wide as frame 1, but, also as shown in FIG. 2, appendage 5 would within a short distance from surface 2 taper down to a width consistent with the above requirement of compatability with the shoulder. The end 6 of appendage 5 distal from surface 2 may be of a size and shape conducive to convenient gripping by the hand, thereby facilitating the carrying of the device by hand when desired. The surface 7 of the inner arc defined by appendage 5 should be padded to enable comfort to the user when the device is carried over the shoulder.

Feet 8, mounted on lower surface 3 at each corner, are capable of the stable support of the device on a supporting surface. The feet are of a composition having a high degree of adhesion with the surface on which the platform is rested. The composition might be bare metal with the tip of the feet pointed or with a sharp edge when the device is used on the ground or on a surface such as ice where it is advantageous for the feet to dig into the surface for the best purchase or adhesion. The composition might be of a material such as silicon rubber which would provide excellent adhesion against a smooth metallic surface such as the aluminum used in the outer skin of a semi-trailer as well as tolerance for the high temperatures sometimes encountered such as on the roof of a semi-trailer. The versatility of the device would be enhanced by the feet having the capacity to attach to interchangeable tips 9 with tips 9 being of an appropriate composition selected for the support surface involved at the time in question.

Additional tool and material attachment and storage means may be built into the kneeling platform of my invention depending on the use for which the platform is employed. For example, the breakaway part of the view in FIG. 1 shows drawer 10 fitted into frame 1 at the edge opposite the edge on which appendage 5 is attached. The drawer would be suitable for the storage of tools and parts within the platform. Drawer 10 like pad 4 would have latching means to prevent it from opening except when desired.

The frame may have associated with it various other attachment means such as straps and recesses. For example, there is shown strap 11 (best shown in FIG. 2) which a semi-trailer mechanic such as myself might use to attach a silicone caulking gun to a longitudinal edge of the platform at the cartridge end of the gun. Recess 12 would accept the bent tip of the ratchet arm of the gun when in a fully extended position.

In conclusion, the kneeling platform as shown in the figures would be very useful for outdoor mechanics, particularly mechanics doing maintenance and repair work on semi-trailers. Whether the task is sealing, patching, straightening or replacing, my invention provides a relatively safe and secure working platform which may be easily and unobtrusively carried to work sites with the workman having both arms free for climbing. There will be no need to carry rivets, silicone seal, bucking guns or hammers to the roof of the trailer separately because of the built-in storage and attachment capacity of the device of my invention.

My invention claimed is:

1. A kneeling platform comprising in combination:

(a) a frame having upper and lower surfaces;

(b) a kneeling pad mounted on said upper surface;

(c) a single arcuate shaped appendage affixed at a midpoint to an edge of said frame curving above and over said upper surface, said appendage being of a size and shape to be used as a handle and conforming to a human shoulder to enable said platform to be carried against the back by hooking said appendage over a single shoulder; and (d) feet mounted on said lower surface capable of the stable support of said platform on a supporting surface, the portion of said feet in contact with the supporting surface being of a composition having a high degree of adhesion with said supporting surface.

2. The platform of claim 1 wherein said frame defines a rectangular prism, having a relatively short and a relatively long axis, said appendage being attached to said frame on an edge perpendicular to said long axis.

3. The platform of claim 1 wherein said kneeling pad is hinged to said upper surface, said frame having a recess therein through said upper surface covered by said pad, access to said recess obtained by rotating said pad on said hinge away from said upper surface, said recess thereby functioning as a storage compartment.

4. The platform of claim 2 wherein a drawer is fitted into said frame at the edge opposite the edge on which said appendage is attached to enable the storage of tools and parts within said platform.

5. The platform of claim 1 wherein the end of said appendage distal from said upper surface is of a size and shape conducive to convenient gripping by a hand, to facilitate the carrying of said platform by hand.

6. The platform of claim 1 wherein the surface of the inner arc defined by said appendage is padded to enable comfort to the user when the platform is carried over a single shoulder.

* * * * *